US005901503A

United States Patent [19]

Dalene et al.

[11] Patent Number: 5,901,503

[45] Date of Patent: May 11, 1999

[54] SWIMMING POOL DOME

[76] Inventors: Steven J. Dalene; Rick Dalene, both of 39 Harned Rd., Commack, N.Y. 11725

[21] Appl. No.: 09/024,685

[22] Filed: Feb. 17, 1998

[51] Int. Cl.[6] ..... E04H 15/20; E04H 4/00

[52] U.S. Cl. ..... 52/2.11; 52/3; 52/5; 4/498; 4/499

[58] Field of Search ..... 52/2.11, 3, 5; 4/498, 4/499, 560

[56] References Cited

U.S. PATENT DOCUMENTS

| | | | |
|---|---|---|---|
| 3,063,062 | 11/1962 | Logan | 4/499 |
| 3,184,763 | 5/1965 | Kennedy | 4/499 |
| 5,517,702 | 5/1996 | Fraher | 4/498 |

*Primary Examiner*—Carl D. Friedman
*Assistant Examiner*—Brian E. Glessner
*Attorney, Agent, or Firm*—Goldstein & Canino

[57] ABSTRACT

A pool dome for covering an outdoor swimming pool during the fall and winter seasons comprising vertical structural walls and a plurality of inflatable sections formed between the walls. The vertical structural walls provide sufficient structural support for the inflatable sections capable of holding its dome shape even during heavy wind, rain, and snow conditions. The swimming pool dome is sized and shaped to cover the entire water surface of the swimming pool and lies between the pool water and the cover for raising the cover in a dome shape to prevent rain water, snow, ice, and other unwanted debris from collecting on top of the pool cover.

2 Claims, 3 Drawing Sheets

SWIMMING POOL DOME

BACKGROUND OF THE INVENTION

This invention relates to a swimming pool dome. More particularly, the invention relates to a swimming pool dome which employs vertical structural walls, and a plurality of inflatable sections formed between the walls, designed for raising a pool cover in a rigid dome shape and retaining the rigid dome shape even under heavy rain or snow storms.

A wide variety of pool covers are available for keeping debris out of outdoor swimming pools while they are not in use during the fall and winter seasons. However, many of the existing pool covers allow many gallons of rainwater, snow, ice, and unwanted debris to build-up on the cover. This not only causes the cover to sag under the weight accumulation of the water and debris but also increases the possibility of contaminating the pool water with algae, dust, and dirt that are often mixed with the collected water. In addition, when the swimming pools are reopened in the spring, it is difficult to remove the pool cover without having the accumulation of water and debris collected on top thereof from falling into the pool water.

Various references uncovered in the prior art provide inflatable swimming pool covers to achieve an arched configuration over the pool in an effort to keep debris out of the pool. For example, U.S. Pat. No. 4,048,678 to Chillino discloses a swimming pool cover which extends dome-like over the entire pool and has a skirt welded to the inner surface of the cover and engaging the pool walls. Likewise, U.S. Pat. No. 4,685,254 to Terreri discloses a pool cover support comprising a balloon positioned between the water surface and a cover for elevating the center of the cover. U.S. Pat. No. 4,953,239 to Gadsby discloses another inflatable swimming pool cover which floats on the swimming pool water surface and has a bulbous surface rising above the level of the swimming pool perimeter. Similarly, U.S. Pat. No. 5,144,704 to Genzel discloses a pool cover utilizing multiple, laterally displaced air compartments which are fixed in location with respect to each other, and are integral portions of the cover.

Despite all these inflatable swimming pool covers, there is still a further need to provide an improved pool dome. Such a pool dome should serve to give rainwater, leaves, and the like a path to slide down so they do not accumulate on the pool cover, thereby reducing amount of work necessary to reopen the pool in the spring. Moreover, such a pool dome should incorporate vertical structural walls which adds sufficient strength to the supporting capabilities of the inflatable sections to allow the pool dome to resist a wide range of forces of nature that it may experience during the fall and winter seasons.

While these units mentioned above may be suitable for the particular purpose employed, or for general use, they would not be as suitable for the purposes of the present invention as disclosed hereafter.

SUMMARY OF THE INVENTION

It is an object of the invention to provide a convex shaped pool dome which serves to give rainwater, leaves, and the like a path to slide down so they do not accumulate on the pool cover, thereby reducing amount of work necessary to reopen the pool in the spring.

It is another object of the invention to provide a swimming pool dome having vertical structural walls which support the inflatable sections formed between the walls in a dome shape with sufficient strength so as to help retain its dome shape without the risk of collapsing even during heavy rain or snow conditions.

It is yet another object of the invention to provide a swimming pool dome which may be sized and shaped to fit a wide range of swimming pool configurations including above-ground and in-ground swimming pools.

The invention is a pool dome for covering an outdoor swimming pool during the fall and winter seasons comprising vertical structural walls and a plurality of inflatable sections formed between the walls. The vertical structural walls provide sufficient structural support for the inflatable sections capable of holding its dome shape even during heavy wind, rain, and snow conditions. The swimming pool dome is sized and shaped to cover the entire water surface of the swimming pool and lies between the pool water and the cover for raising the cover in a dome shape to prevent rain water, snow, ice, and other unwanted debris from collecting on top of the pool cover.

To the accomplishment of the above, and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 2:
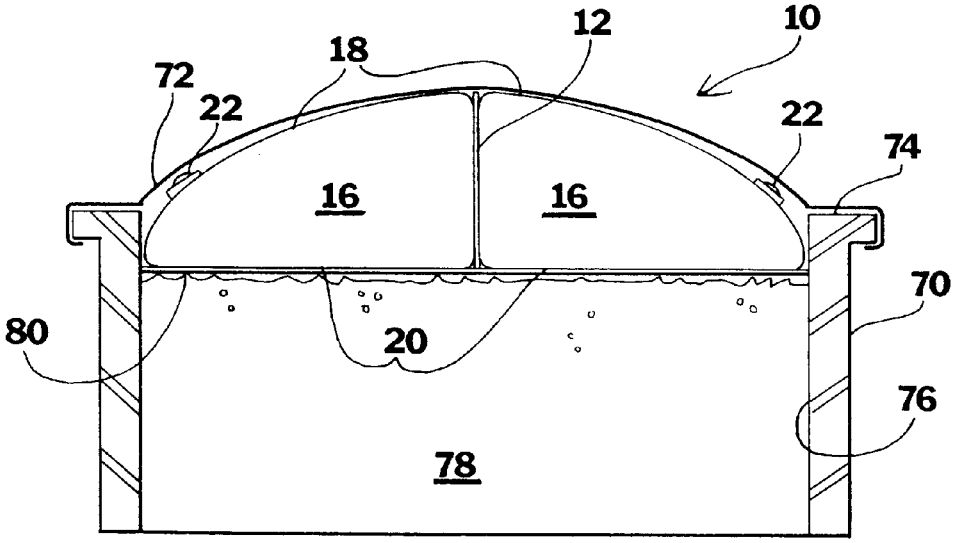
FIG. 2 is a front elevational view of the present invention placed between the water surface of the swimming pool and the pool cover.
Figure 3:
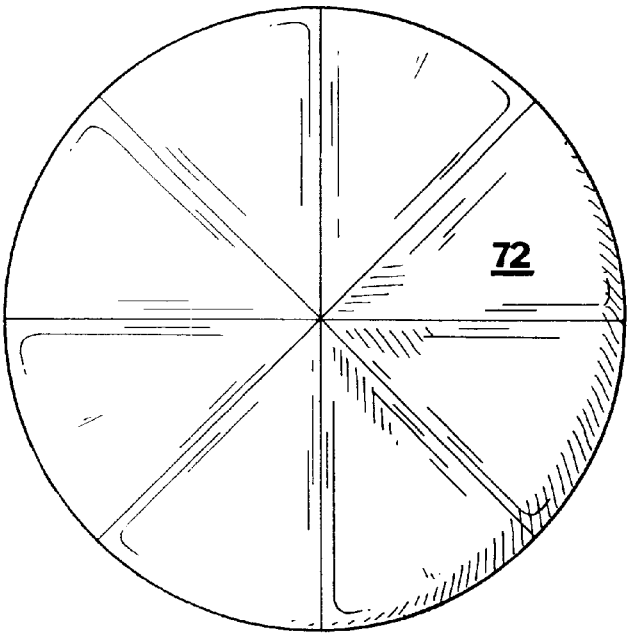
FIG. 3 is a top view of the present invention, wherein a pool cover is placed over the pool dome providing a barrier between the interior of the swimming pool and surrounding environment.

FIG. 2 illustrates a swimming pool 70 incorporating the principles of a preferred embodiment of a swimming pool dome 10. For a better understanding of the present invention, the circular shaped swimming pool 70 is illustrated consisting generally of a pool cover 72, a pool rail 74, a cylindrical inner wall 76, pool water 78, and surface of the pool water 80. The swimming pool dome 10 is sized and shaped to cover the entire water surface 80 of the swimming pool 70 and is disposed between the pool water 78 and the cover 72 for raising the cover 72 in a dome shape so as to prevent rain water, snow, ice, and other undesirable debris from collecting on the pool cover 72.

FIGS. 1, 2, 4, and 6 illustrate the swimming pool dome 10 comprising a central vertical axis 12 and a plurality of vertical structural walls 14 extending radially outward from the central vertical axis 12. The shape of the vertical structural walls 14 is selected such that the vertical structural walls 14 can be joined together into a dome shape which serves to give rainwater, leaves, and the like a path to slide down. The length of the vertical structural walls 14 is selected so that the circular periphery of the pool dome 10 coincides with the configuration of the cylindrical inner wall 76 of the swimming pool 70, thereby permitting the pool dome 10 to cover substantially the entire water surface 80 of the swimming pool 70.

Figure 1:
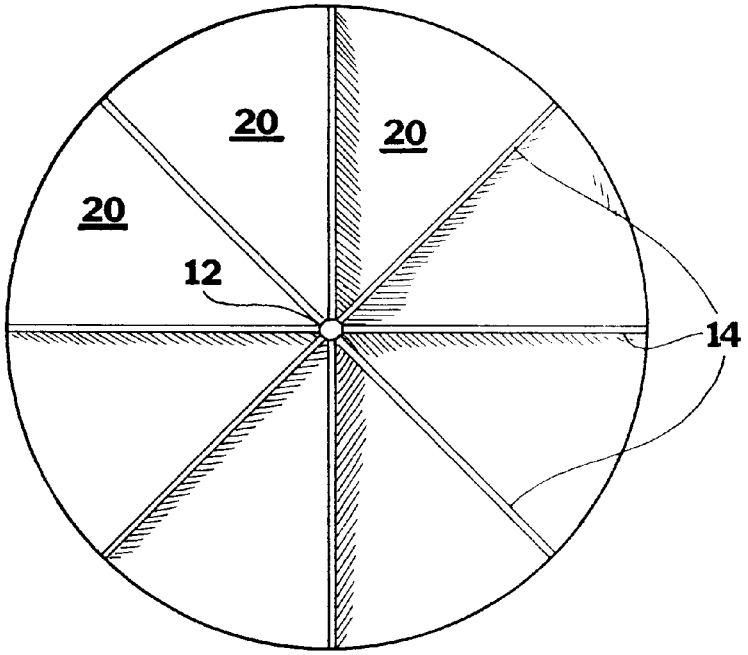
FIG. 1 is a top view of the vertical structural walls of the present invention extending radially outward from the central vertical axis.
Figure 4:
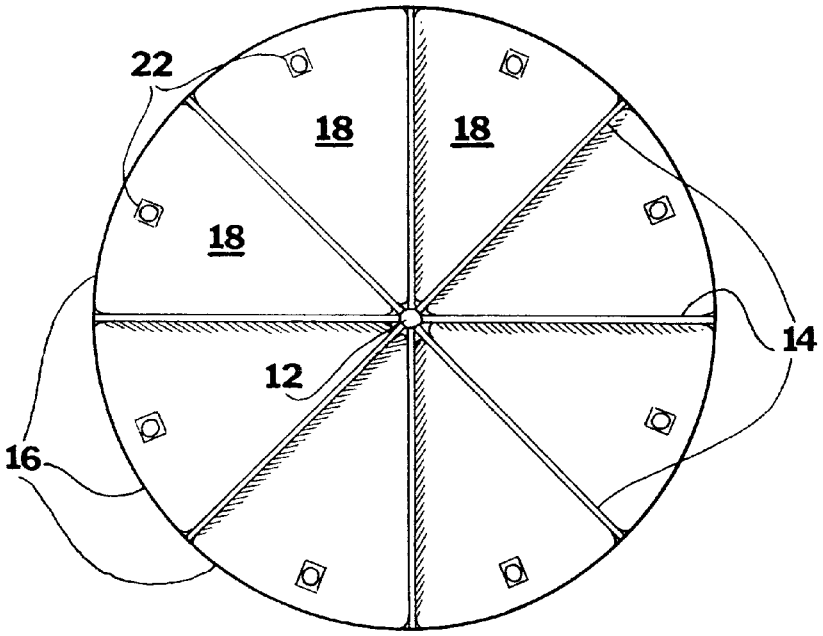
FIG. 4 is a top view of the present invention, illustrating a plurality of inflatable sections formed between the vertical structural walls.
Figure 6:
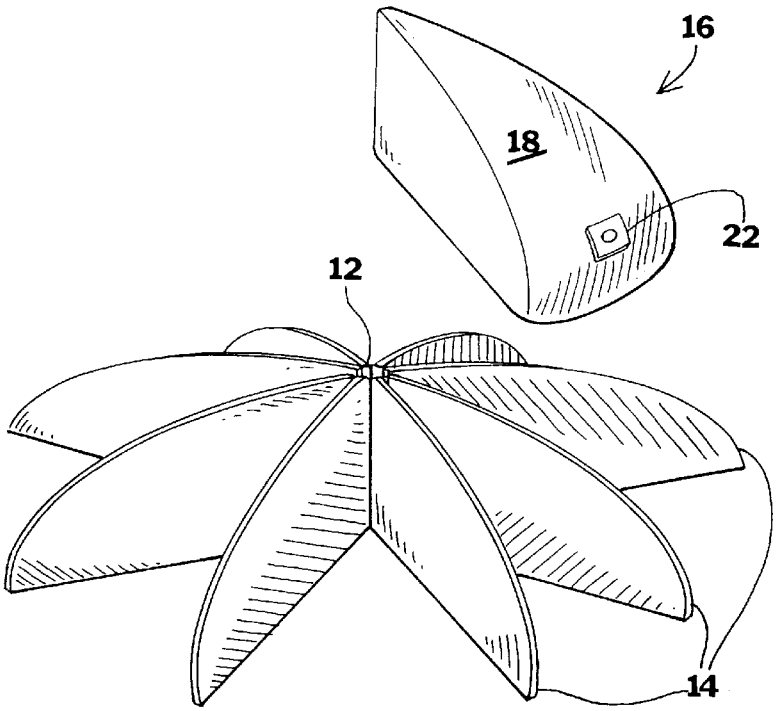
FIG. 6 is a diagrammatic perspective view of the vertical structural walls of a preferred embodiment of the present invention, which are configured to conform to a circular shaped swimming pool.

FIGS. 1, 4, and 6 illustrate the swimming pool dome 10 further comprising a plurality of pie-shaped inflatable sections 16 formed between the vertical structural walls 14. Each inflatable section 16 is defined by a top panel 18 extending outwardly and downwardly from the central vertical axis 12, a flat bottom panel 20, and the vertical structural walls 14, and includes an air valve 22 located on the top panel 18 for inflating and deflating of the pool dome 10. The inflatable sections 16 are individually air tight prohibiting escape or transfer of air between the inflatable sections 16 for facilitating a rigid construction. Although FIG. 4 illustrates the swimming pool dome 10 having eight air valves 22, one for each inflatable section 16, it should be noted that the construction of the pool dome 10 can be modified so that a single valve configuration can be utilized. One important feature of the present invention is the vertical structural walls 14 which support the inflatable sections 16 in the rigid dome shape and provide sufficient structural support so that the inflatable sections 16 are able to retain its dome shape even during heavy wind, rain, or snow conditions. The vertical structural walls 14 can be constructed of vinyl or any other suitable material capable of achieving the desired function, including plastic.

To winterize the swimming pool 70, the pool dome 10 is first placed on the surface 80 of the pool water. Each of the inflatable sections 16 are then individually filled with sufficient amount of air allowing the pool dome 10 to inflate to a dome shape, as viewed in drawing FIG. 2. Inflation is achieved by forcing air into the inflatable sections 16 through the valves 22 attached thereto using a suitable air pump and air conduits, which are not shown here. Whereupon, the pool cover 72 is placed over the pool dome 10 and is secured to the rail 74 of the swimming pool 70 by placing weights along the perimeter of the cover 72 or any suitable securing fasteners can be employed as would be appreciated by those skilled in the art, including grommets, ropes, or bungie cords. It may be desirable to tightly secure the pool cover 72 to the rail 74 of the pool 70 in order to keep the interior of the pool from being contaminated by unwanted debris from the surrounding environment.

Figure 5:
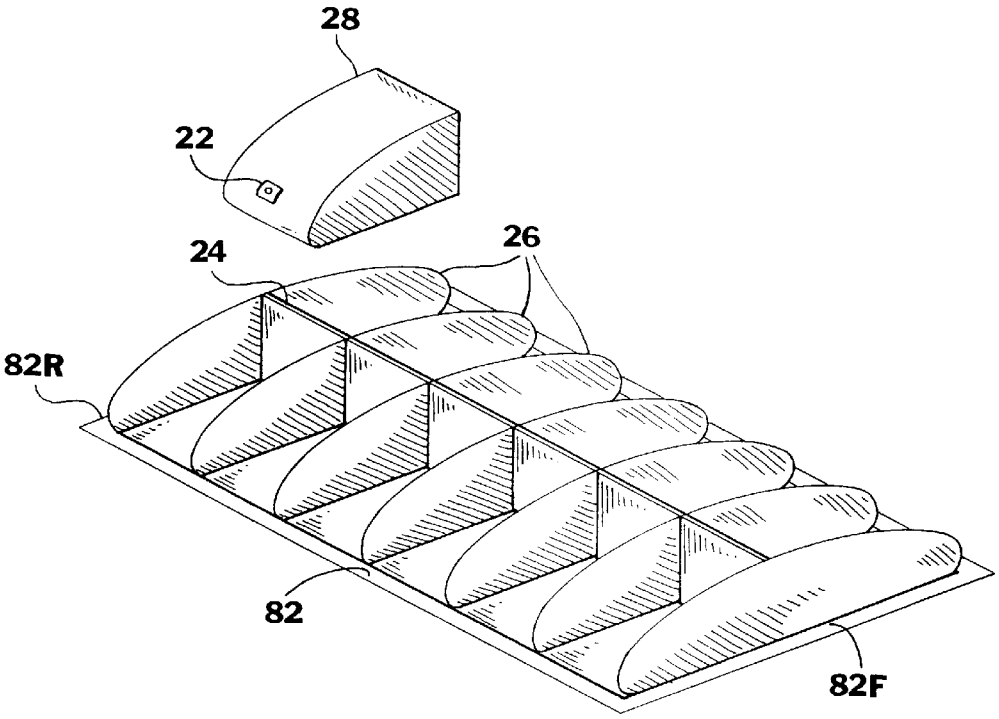
FIG. 5 is a diagrammatic perspective view of the vertical structural walls of an alternative embodiment of the present invention, which are configured to conform to a rectangular shaped swimming pool.

FIG. 5 illustrates an alternative embodiment of the pool dome 10 which is adapted for a rectangular shaped swimming pool 82 having opposite front 82F and rear 82R ends. The rigid structural frame of the alternative embodiment includes a central vertical wall 24 which extends longitudinally between the front end 82F and the rear end 82R of the pool 82, and a plurality of parallel vertical walls 26 extending laterally along the central vertical wall 24. The alternative embodiment of the pool dome 10 further includes a plurality of inflatable sections 28 formed between the vertical structural walls 26. While the embodiments of the present invention are disclosed in relation to winterizing of standard circular and rectangular shaped swimming pools, it will be apparent to those skilled in the art that the pool dome disclosed herein may be modified to suit swimming pools of different shapes and sizes, including custom designed, above-ground, and in-ground swimming pool configurations.

Many specific details contained in the above description merely illustrate some preferred embodiments and should not be construed as a limitation on the scope of the invention.

What is claimed is:

1. A pool dome for covering a swimming pool having an overall circular shape, comprising:

a) a pool cover;

b) a plurality of vertical structural walls; and c) a plurality of inflatable sections, each said inflatable section formed between said vertical structural walls and defined by a top panel, a bottom panel, and said vertical structural walls, each inflatable section is individually air tight prohibiting transfer of air between the inflatable sections, each inflatable section further comprising an air valve located on the top panel for inflating and deflating thereof, such that when fully inflated said inflatable sections raise said pool cover in a convex shape, further comprising a central vertical axis, wherein the plurality of vertical structural walls extend radially outward from said central vertical axis, each of the vertical structural walls is shaped such that the vertical structural walls can be joined together to form a convex shaped dome.

2. A pool dome for covering a swimming pool having an overall rectangular shape having opposite front and rear ends, comprising:

a) a pool cover;

b) a plurality of vertical structural walls; and c) a plurality of inflatable sections, each inflatable section formed between said vertical structural walls and defined by a top panel, a bottom panel, and said vertical structural walls, each inflatable section is individually air tight prohibiting transfer of air between the inflatable sections, each inflatable section further comprising an air valve located on the top panel for inflating and deflating thereof, such that when fully inflated said inflatable sections raise said pool cover in a convex shape, further comprising a central wall which is adapted to longitudinally between the front end and the rear end of the swimming pool, wherein the plurality of vertical structural walls extend laterally along the central wall.

* * * * *